US007952278B2

(12) United States Patent
Lee et al.

(10) Patent No.: US 7,952,278 B2
(45) Date of Patent: May 31, 2011

(54) PROTECTIVE LAYER AND PLASMA DISPLAY PANEL INCLUDING THE SAME

(75) Inventors: Min-Suk Lee, Suwon-si (KR); Jong-Seo Choi, Suwon-si (KR); Matulevich Yuri, Suwon-si (KR); Suk-Ki Kim, Suwon-si (KR); Young-Su Kim, Suwon-si (KR); Deok-Hyun Kim, Suwon-si (KR); Hee-Young Chu, Suwon-si (KR); Soon-Sung Suh, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 201 days.

(21) Appl. No.: 12/318,461

(22) Filed: Dec. 30, 2008

(65) Prior Publication Data

US 2009/0167177 A1 Jul. 2, 2009

(30) Foreign Application Priority Data

Dec. 31, 2007 (KR) ..... 10-2007-0141660

(51) Int. Cl.
*H01J 17/49* (2006.01)

(52) U.S. Cl. ..... 313/582; 313/586; 313/587; 313/635

(58) Field of Classification Search ..... 313/582, 313/584, 586, 587, 635
See application file for complete search history.

(56) References Cited

U.S. PATENT DOCUMENTS 7,432,656 B2 10/2008 Morita et al.

FOREIGN PATENT DOCUMENTS

JP 07-192630 A 7/1995
KR 10-2005-0070142 A 7/2005

*Primary Examiner* — Vip Patel
(74) *Attorney, Agent, or Firm* — Lee & Morse, P.C.

(57) ABSTRACT

A protective layer of a plasma display panel includes smoky magnesium oxide, the smoky magnesium oxide having single crystal magnesium oxide with a plurality of cavities therein.

20 Claims, 4 Drawing Sheets

PROTECTIVE LAYER AND PLASMA DISPLAY PANEL INCLUDING THE SAME

BACKGROUND OF THE INVENTION

1. Field of the Invention

Embodiments of the present invention relate to a protective layer and to a plasma display panel (PDP) including the same. More particularly, embodiments of the present invention relate to a protective layer capable of reducing discharge firing voltage in a PDP, and to a PDP including the same.

2. Description of the Related Art

PDPs refer to display devices that display images using visible light emitted via a gas discharge phenomenon. In particular, a discharge voltage may be applied to a discharge gas via a plurality of electrodes between two substrates to generate ultraviolet (UV) light, so the UV light may excite phosphor materials between the two substrates.

A conventional PDP, e.g., an alternating current PDP, may include two substrates spaced apart from each other, so discharge cells may be formed therebetween. The conventional PDP may further include electrodes and phosphor material between the substrates. Further, the conventional PDP may include a protective layer on one of the two substrates, so the protective layer may face the discharge cells between the two substrates. The protective layer may protect the electrodes, and may generate secondary electrons.

In order to realize a full high definition PDP, a size of the discharge cells may be reduced. A reduced size of the discharge cells, however, may reduce stability of a discharge therein. In addition, a reduced size of the discharge cells may increase a size of a non-discharge space in the PDP, so overall brightness may be reduced.

Attempts have been made to increase brightness of the PDP via use of a xenon (Xe) gas in the discharge gas in order to increase generation of UV light, i.e., realize high brightness since the visible light transformation may be increased to quantum efficiency. An increased content of Xe in the discharge gas, however, may cause an increase in a discharge firing voltage. Further, an increased content of Xe in the discharge gas may reduce a discharge delay time and reduce temperature stability, i.e., discharge time and voltage may have an increased dependency on temperature.

SUMMARY OF THE INVENTION

Embodiments of the present invention are therefore directed to a protective layer and a PDP including the same, which substantially overcome one or more of the disadvantages and shortcomings of the related art.

It is therefore a feature of an embodiment of the present invention to provide a protective layer that can reduce a discharge delay time when a discharge gas includes a relatively high partial pressure of Xe gas.

It is another feature of an embodiment of the present invention to provide a protective layer that can reduce a discharge firing voltage when a discharge gas includes a relatively high partial pressure of Xe gas.

It is yet another feature of an embodiment of the present invention to provide a PDP with a protective layer including one or more of the above features.

At least one of the above and other features and advantages of the present invention may be realized by providing a protective layer of a PDP, including smoky magnesium oxide, the smoky magnesium oxide having single crystal magnesium oxide with a plurality of cavities therein. The plurality of cavities may be filled with a hydrogen gas. The hydrogen gas in the cavities may be at a partial pressure of about 20 atm to about 200 atm. The cavities may have crystal structures, the crystal structures including both hexahedral structures and octahedral structures. The protective layer may include a distorted lattice structure. The cavities may have a diameter of about 0.05 μm to about 10 μm. The protective layer may further include a dopant in the single crystal magnesium oxide, the dopant including one or more of Al, Ca, Fe, Si, K, Na, Zr, Mn, Cr, Zn, B, and/or Ni. An amount of the dopant in the single crystal magnesium oxide may be about 50 ppm to about 250 ppm. The cavities may include oxygen voids combined with magnesium oxide voids. The single crystal magnesium oxide may include compressed magnesium oxide powder mixed with magnesium hydroxide.

At least one of the above and other features and advantages of the present invention may be realized by providing a PDP, including a first substrate facing a second substrate, a plurality of barrier ribs between the first and second substrates, the barrier ribs defining a plurality of discharge cells, a plurality of electrodes between the first and second substrates, at least one dielectric layer between the first and second substrates, a protective layer between the first and second substrates, the protective layer including smoky magnesium oxide, the smoky magnesium oxide having single crystal magnesium oxide with a plurality of cavities therein, and a discharge gas in the discharge cells.

The cavities of the protective layer may be filled with a hydrogen gas. The hydrogen gas in the cavities of the protective layer may be at a partial pressure of about 20 atm to about 200 atm. The cavities in the protective layer may have crystal structures, the crystal structures including both hexahedral structures and octahedral structures. The protective layer may include a distorted lattice structure. The cavities in the protective layer may have a diameter of about 0.05 μm to about 10 μm. The protective layer may include a dopant in the single crystal magnesium oxide, the dopant including one or more of Al, Ca, Fe, Si, K, Na, Zr, Mn, Cr, Zn, B, and/or Ni. An amount of the dopant in the single crystal magnesium oxide may be about 50 ppm to about 250 ppm. The discharge gas may include a mixture of xenon gas and helium gas or a mixture of xenon gas, helium gas, and neon gas. The discharge gas may include xenon gas in an amount of about 10% to about 30% by volume of a total discharge gas.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
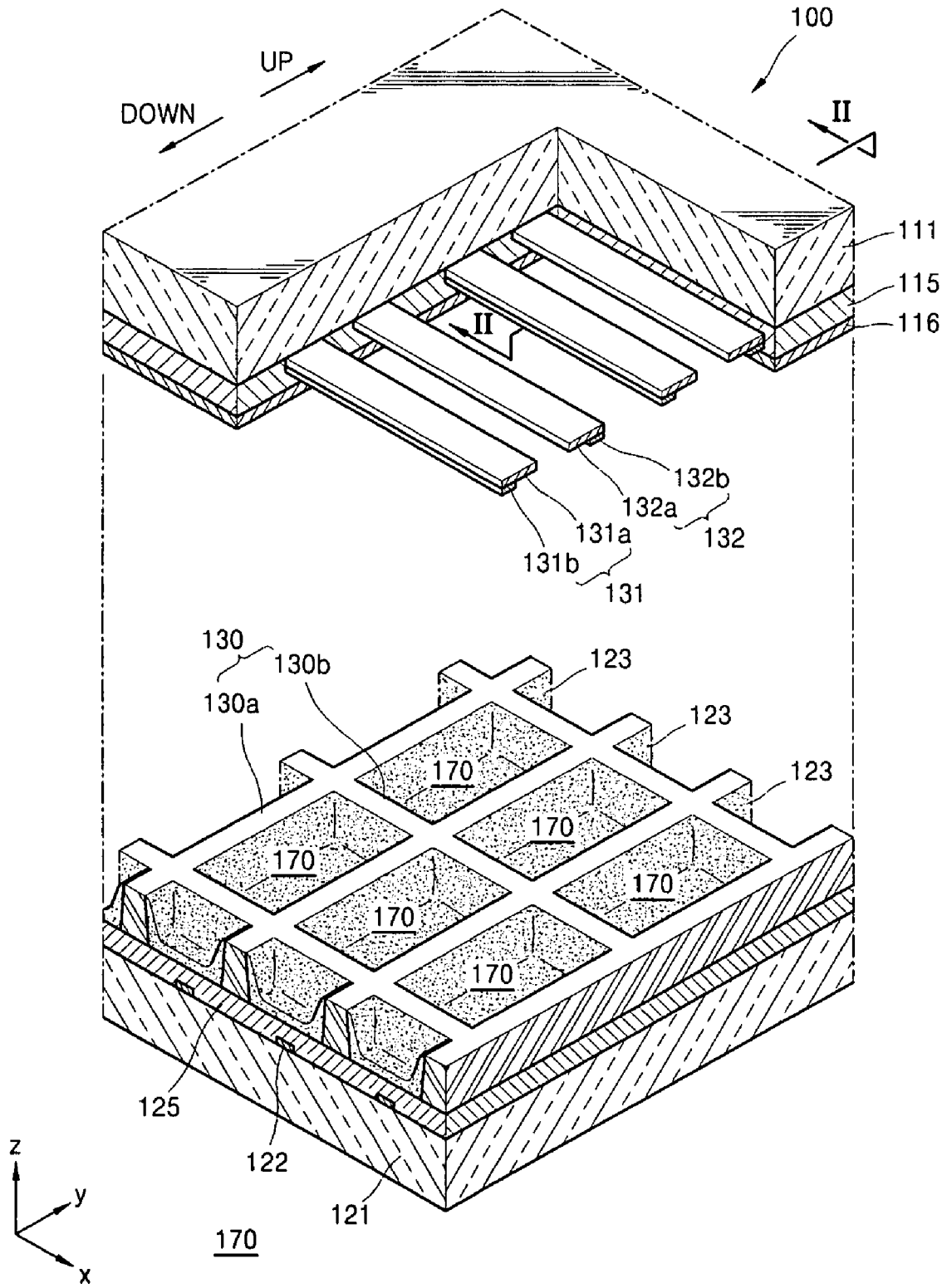
FIG. 1 illustrates a partial perspective view of a PDP according to an embodiment of the present invention.

Korean Patent Application No. 10-2007-0141660, filed on Dec. 31, 2007, in the Korean Intellectual Property Office, and entitled: "Protective Layer and Plasma Display Panel Comprising the Same," is incorporated by reference herein in its entirety.

Exemplary embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of elements and regions may be exaggerated for clarity of illustration. It will also be understood that when an element is referred to as being "on" another element or substrate, it can be directly on the other element or substrate, or intervening elements may also be present. Further, it will be understood that the term "on" can indicate solely a vertical arrangement of one element with respect to another element, and may not indicate a vertical orientation, e.g., a horizontal orientation. In addition, it will also be understood that when an element is referred to as being "between" two elements, it can be the only element between the two elements, or one or more intervening elements may also be present. Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

Figure 2:
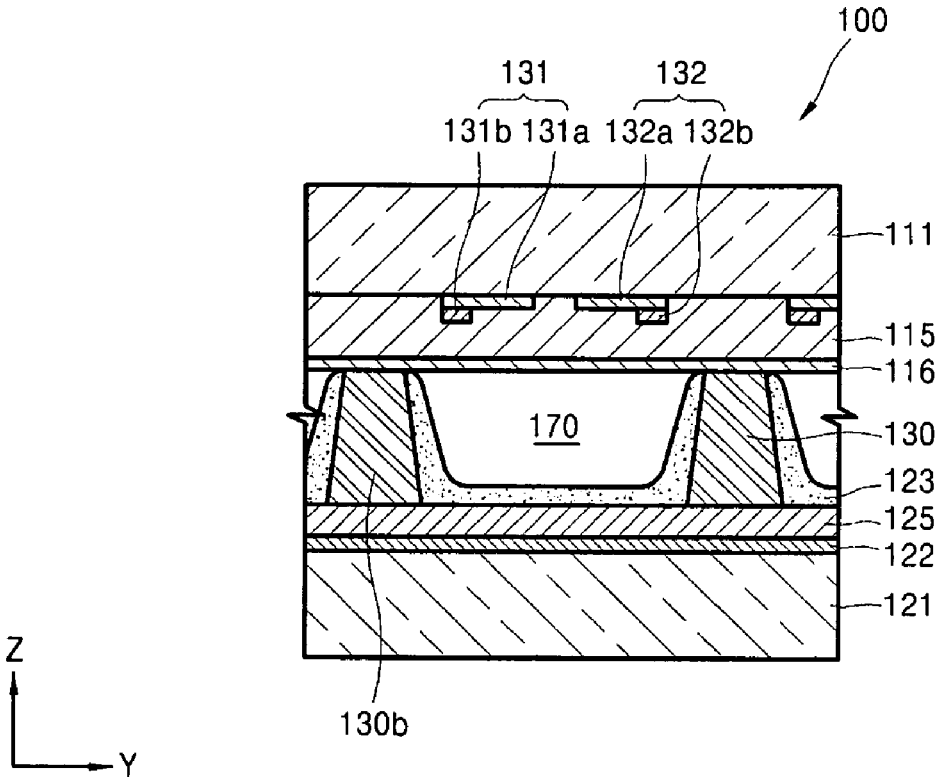
FIG. 2 illustrates a cross-sectional view along line II-II of FIG. 1.

FIG. 1 illustrates a partial, perspective view of a PDP 100 according to an embodiment of the present invention. FIG. 2 illustrates a cross-sectional view along line II-II of FIG. 1. Referring to FIGS. 1-2, the PDP 100 may include a first substrate 111, a second substrate 121, first electrodes 131, second electrodes 132, third electrodes 122, barrier ribs 130, a protective layer 116, a phosphor layer 123, a first dielectric layer 115, a second dielectric layer 125, and a discharge gas (not shown).

The protective layer 116 may include smoky magnesium oxide (MgO). Smoky MgO may include single crystal MgO with a plurality of cavities. The cavities in the smoky MgO may have a crystal structure, e.g., a hexahedral cavity shape and an octahedral cavity shape, and the cavities may be filled with a hydrogen ($H_2$) gas. Forming the protective layer 116 to include smoky MgO may be advantageous in providing a PDP with full high definition single scan, low voltage discharge, and low power consumption at a relatively high partial pressure of xenon (Xe), i.e., about 10% or more by volume of the discharge gas, as will be described in more detail below.

The first and second substrates 111 and 121 may be front and rear substrates, respectively. The first and second electrodes 131 and 132 may be pairs of sustain electrodes that mutually generate a discharge, and the third electrodes 122 may be address electrodes to which a data pulse may be applied to select discharge cells to be operated, i.e., where the discharge may be generated. The first and second dielectric layers 115 and 125 may be front and rear dielectric layers, respectively. A general structure of the PDP 100 may be as follows.

The first substrate 111 and the second substrate 121 may be spaced apart and face each other, and may define a discharge space therebetween, i.e., a space where discharge may be generated. The first substrate 111 and the second substrate 121 may be formed of any suitable material, e.g., glass having high visible light transmittance. The first substrate 111 and the second substrate 121 may be colored in order to increase bright room contrast. The first and second substrates 111 and 121 may be attached to each other by using frit glass therebetween, i.e., the frit glass may be applied along edges of the first and second substrates 111 and 121, so the discharge space may be sealed.

The barrier ribs 130 may be disposed between the first substrate 111 and the second substrate 121, e.g., the barrier ribs 130 may be formed on the second substrate 121. The barrier ribs 130 may define a plurality of discharge cells 170 in the discharge space between the first and second substrates 111 and 121, and may maintain a discharge distance and prevent or substantially minimize optical and electrical cross-talk between adjacent discharge cells 170. As illustrated in FIG. 1, the barrier ribs 130 may define the discharge cells 170 to have rectangular cross-sections arranged in a matrix shape. It is noted, however, that the barrier ribs 130 may define the discharge cells 170 to have any suitable cross-section, e.g., polygonal, circular, or an oval cross-section, or any suitable arrangement, e.g., open shape, waffle, and/or delta. Examples of polygonal cross-sections of the discharge cells 170 may include triangular and/or pentagonal cross-sections. Examples of open shape arrangements of the discharge cells 170 may include a stripe-pattern. The barrier ribs 130 may include vertical barrier ribs 130*a* and horizontal barrier ribs 130*b*. For example, as illustrated in FIGS. 1-2, the vertical barrier ribs 130*a* may extend along a vertical direction, i.e., along the y-axis, and the horizontal barrier ribs 130*b* may extend along a horizontal direction, i.e., along the x-axis. Accordingly, each of the discharge cells 170 may be defined by a pair of adjacent vertical barrier ribs 130*a* and a pair of adjacent horizontal barrier ribs 130*b*.

The pairs of first and second electrodes 131 and 132 may be disposed on the first substrate 111, and may face the second substrate 121. The first and second electrodes 131 and 132 may be spaced apart and parallel to each other, and may be arranged in an alternating pattern, e.g., one second electrode 132 may be between two first electrodes 131. Accordingly, one first electrode 131 and one second electrode 132 may define a pair of sustain electrodes to generate a discharge. For example, the first and second electrodes 131 and 132 may be X and Y electrodes, respectively, or vice versa. Accordingly, the X electrode may function, e.g., as a common electrode, and the Y electrode may function, e.g., as a scan electrode. Accordingly, each discharge cell 170 may have a corresponding pair of X and Y electrodes. It is noted that the other configurations of the first and second electrodes 131 and 132, e.g., the first and second electrodes 131 and 132 disposed at a predetermined distance from the first substrate 111, disposed on a surface of the barrier ribs 130, or disposed to bury the barrier ribs 130, are within the scope of the present invention. It is further noted that even though a three-electrode structure is illustrated in FIGS. 1-2, embodiments of the present invention may be applied to a two-electrode structure, e.g., the electrode pairs 131 and 132 may be a single electrode.

Each of the first and second electrodes 131 and 132 may include first and second transparent electrodes 131*a* and 132*a*, respectively, and first and second bus electrodes 131*b* and 132*b*, respectively. The first and second transparent electrodes 131*a* and 132*a* may include a transparent conductive material that may generate a discharge without interrupting light transmittance through the first substrate 111, e.g., indium tin oxide (ITO). The first and second bus electrodes 131*b* and 132*b* may include a metal having a narrow width, and may be electrically connected to the first and second transparent electrodes 131*a* and 132*a*, respectively. Use of the first and second bus electrodes 131*b* and 132*b* may minimize resistance of the transparent conductive material in the first and second transparent electrodes 131*a* and 132*a*, respectively. Thus, the minimized resistance may prevent or substantially minimize voltage drop in a lengthwise direction of the first and second transparent electrodes 131*a* and 132*a*, so driving power may be minimized and response speed may be increased.

The first and second bus electrodes 131*b* and 13 2*b* may extend along the x-axis, and may be parallel to each other. As such, each of the first and second bus electrodes 131*b* and 132*b* may extend along a linear array of discharge cells 170, e.g., a row of discharge cells 170 along the x-axis. The first and second transparent electrodes 131*a* and 132*a* may have a rectangular shape, and may be electrically connected to the first and second bus electrodes 131*b* and 132*b*, respectively. The first and second transparent electrodes 131*a* and 132*a* may be disposed discontinuously in each of the discharge cells 170 along the first and second bus electrodes 131*b* and 132*b*. Accordingly, a first side of the first and second transparent electrodes 131*a* and 132*a* may be connected to the first and second bus electrodes 131*b* and 132*b*, respectively, and a second side of the first and second transparent electrodes 131*a* and 132*a* may extend toward a center of the respective discharge cell 170. A display line may be defined by a pair of X and Y electrodes, while each X electrode may be used as a common electrode between two adjacent Y electrodes The first dielectric layer 115 may be formed on the first substrate 111, and may cover the first and second electrodes 131 and 132. The first dielectric layer 115 may prevent electrical connection between the first and second electrodes 131 and 132, and may prevent or substantially minimize damage to the first and second electrodes 131 and 132 from colliding charged particles and/or electrons. The first dielectric layer 115 may induce charges. The first dielectric layer 115 may be formed of, e.g., lead oxide (PbO), boron oxide ($B_2O_3$), and/or silicon oxide ($SiO_2$).

The protective layer 116 may be on the first dielectric layer 115, and may face the discharge cells 170. For example, the protective layer 116 may cover the entire first dielectric layer 115. The protective layer 116 may prevent or substantially minimize damage to the first dielectric layer 115 from colliding charged particles and/or electrons during a discharge. It is noted, however, that other configurations of the protective layer 116, e.g., the protective layer 116 may be disposed on the rear dielectric layer 125 or on the barrier ribs 130, are within the scope of the present invention. For example, the first and second electrodes 131 and 132 may be on surfaces of the barrier ribs 130 facing the discharge space, so the protective layer 116 may be on a dielectric layer that faces the discharge cells 170. Alternatively, the first and second electrodes 131 and 132 may be buried in the barrier ribs 130, so the protective layer 116 may be formed on the barrier ribs 130.

The protective layer 116 may emit a large amount of secondary electrons during a discharge to facilitate a plasma discharge, e.g., reduce a discharge firing voltage. The protective layer 116 may be formed as a thin film, e.g., via sputtering or electron beam deposition, after the first dielectric layer 115 is formed. The protective layer 116 may be formed of a material having a high secondary electron emission coefficient and high visible light transmittance. The materials used to firm the protective layer 116 of the PDP 100 will be discussed in more detail below.

The third electrodes 122 may be disposed on the second substrate 121, and may face the first substrate 111. The third electrodes 122 may extend across the discharge cells 170 along the y-axis, i.e., cross the pairs of the first and second electrodes 131 and 132. The third electrodes 122 may generate an address discharge, i.e., a discharge between the first and third electrodes 132 and 122, that may facilitate a sustain discharge between the first and second electrodes 131 and 132 in the discharge cells 170, i.e., the address discharge may reduce a voltage required to generate the sustain discharge. In particular, when the address discharge is finished, wall charges may accumulate near the first and second electrodes 131 and 132, thereby facilitating a sustain discharge therebetween. An intersection of a third electrode 122 with the first and second electrodes 131 and 132 may define a discharge cell 170.

The second dielectric layer 125 may be on the second substrate 121, and may cover the third electrodes 122. The second dielectric layer 125 may be formed of a dielectric material capable of preventing or substantially minimizing damage to the third electrodes 122 from colliding charged particles or electrons during a discharge, e.g., PbO, $B_2O_3$, and/or $SiO_2$.

The phosphor layers 123 may include red, green, and/or blue phosphors, and may be formed in the discharge cells 170. For example, the phosphor layers 123 may be formed on the barrier ribs 130, e.g., on sidewalls of the barrier ribs 130, and/or on the second dielectric layer 125, e.g., on an entire surface of the second dielectric layer 125. The phosphor layers 123 may include a component that may generate visible light when UV light is received. Examples of red phosphors may include $Y(V,P)O_4$:Eu. Examples of green phosphors may include $Zn_2SiO_4$:Mn and/or $YBO_3$:Tb. Examples of blue phosphors may include BAM:Eu. During a sustain discharge, UV light may be generated as an energy level of the excited discharge gas is reduced. The UV light may excite the phosphor layers 123 in the discharge cells 170, so the phosphor layers 123 may emit visible light as an energy level of the excited phosphor layers 123 is reduced. The visible light may be emitted through the first dielectric layer 115 and through the first substrate 111 to form an image.

Once the first and second substrates 111 and 121 are sealed, the discharge gas may be filled in each of the discharge cells 170. The discharge gas may include a mixture of Xe gas with helium (He) gas or a mixture of Xe with He and neon (Ne) gas. Xe gas may generate UV light, i.e., Xe ions emission at about 147 nm and Xe molecules emissions at about 173 nm. Ne gas may reduce discharge firing voltage and may stabilize discharge. He gas may increase mobility of Xe gas, so emission of Xe molecules at about 173 nm may increase. In particular, the discharge gas may include Xe gas in a content of about 10% to about 30% by a total volume of the discharge gas. Xe gas content lower than about 10% by volume may be insufficient to provide high brightness, and Xe gas content greater than about 30% may excessively increase the discharge firing voltage, thereby causing a discharge failure or an abnormal discharge.

A conventional material for forming the protective layer 16 may be optimally used for a Xe gas content of about 7% by volume of a total discharge gas. A content of a Xe gas in the discharge gas in an amount of about 7% by volume, however, may not provide sufficient brightness increase. Further, when a conventional material for forming the protective layer 16 is used, i.e., a conventional single crystal MgO, the discharge delay time may be reduced and the temperature-dependency of the discharge delay time may be greatly increased at a high Xe content. Therefore, since the protective layer 16 according to embodiments of the present invention may include material having a lower discharge voltage than the conventional material, a content of Xe gas in the discharge gas may be about 10% to about 30% by volume of the discharge gas. In other words, embodiments of the present invention provide a material for forming the protective layer 16, so that a low voltage discharge may be realized, despite a relatively high partial pressure of the Xe gas. In particular, the protective layer 116 according to embodiments of the present invention may reduce a discharge firing voltage and a discharge delay time. Thus, the protective layer 116 may reduce the discharge firing voltage under a relatively high partial pressure of the Xe gas. Accordingly, brightness of the PDP 100 may be substantially increased.

Figure 6:
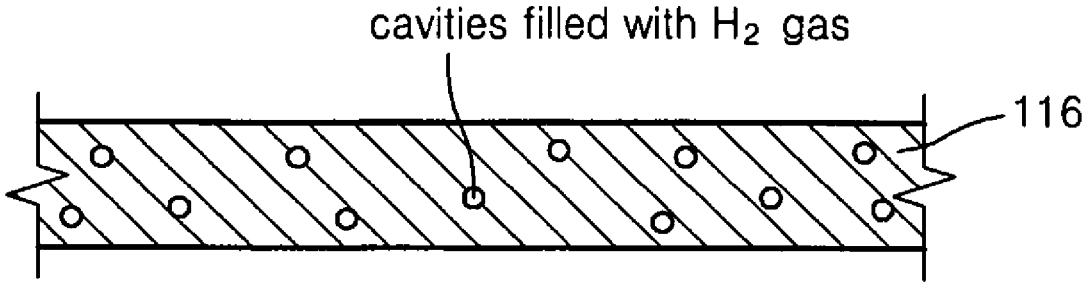
FIG. 6 illustrates a protective layer including a plurality of cavities according to an embodiment of the present invention.

A detailed description of the protective layer 116 is as follows. The protective layer 116 may include smoky MgO. The smoky MgO may include single crystal MgO with a plurality of cavities, e.g., as illustrated in FIG. 6. The cavities may have a crystal shape. In particular, the cavities may include both hexahedral shapes and octahedral shapes. The cavities may have an external shape of, e.g., cubo-octahedral crystals. Accordingly, the protective layer 116 may include a crystal lattice having a distorted structure because of the cavities. In this respect, it is noted that an undistorted lattice of magnesium oxide bulk refers to an undistorted and uniform hexahedral lattice structure, while a distorted crystal lattice of magnesium oxide refers to a structure having altered structure and/or dimensions as compared to the undistorted magnesium oxide bulk.

The plurality of cavities may include $H_2$ gas, e.g., as illustrated in FIG. 6, at a partial pressure of about 20 atm to about 200 atm. For example, the $H_2$ gas content in the cavities may be about 100 atm. In particular, the partial pressure of the $H_2$ gas in the cavities may be related to a size of the cavities. For example, a partial pressure of $H_2$ gas below about 20 atm may be insufficient to fill the cavities, so a decrease of a discharge firing voltage may be insignificant. A partial pressure of $H_2$ gas above about 200 atm may trigger formation of non-uniform cavities, thereby causing non-uniform discharge.

The plurality of cavities may have a diameter of about 0.05 μm to about 10 μm. In particular, the diameter of the cavities may be proportional to the content of the $H_2$ gas. For example, if the diameter of the cavities is smaller than about 0.05 μm, the lattice distortion of protective layer 116 caused by the cavities may be too small and may contain a small amount of $H_2$ gas, so a decrease of a discharge firing voltage may be insignificant. If the diameter of the cavities is greater than about 10 μm, the cavities may be non-uniformly formed, thereby causing a discharge failure or an abnormal discharge.

The smoky MgO may be formed by inducing formation of cavities in the single crystal bulk during manufacturing of the single crystal MgO. For example, bulk voids, i.e., defects, in magnesium (Mg) and oxygen ($O_2$) may be combined in the MgO lattice to form the cavities, i.e., micro-cavities. Such micro-cavities in the MgO may be formed randomly, and may be locally increased and grown, e.g., diffused at a high temperature.

In particular, a raw material, e.g., compressed MgO powder, and a small amount of magnesium hydroxide ($Mg(OH)_2$) may be heated in an arc electric furnace at a temperature of about 2800° C. to from single crystal MgO with cavities, i.e., smoky MgO. A minor amount of hydroxide ion ($OH^-$) may combine oxygen voids $V_O$ and magnesium voids $V_{Mg}$ in the MgO lattice to form cavities in the MgO, i.e., MgO defects, so the hydrogen ions and oxygen ions may be formed in the MgO cavities. The oxygen ions may diffuse into an MgO bulk, so only the hydrogen ions may remain in the MgO cavities, as illustrated in Reaction 1 below. The magnesium voids $V_{Mg}$ in the MgO lattice may be formed thermodynamically, and the oxygen voids $V_O$ in the MgO lattice may be formed through a thermodynamic reaction and heat treatment in a reducing atmosphere, e.g., in a presence of one or more of $H_2$ gas, carbon dioxide ($CO_2$) gas, and so forth.

$$V_{Mg}\text{—}OH^- + V_O + e \rightarrow \text{MgO defects} + H_2 + O_2 \qquad \text{Reaction 1}$$

The microstructure of the smoky MgO may be different than the microstructure of the conventional single crystal MgO, so their chemical and physical properties may be different. In particular, the crystal characteristics of the smoky MgO and the conventional single crystal MgO may be different.

In particular, the conventional single crystal MgO may have a substantially uniform hexahedral crystal lattice structure. Thus, a conventional single crystal MgO having a predetermined size may be cleaved into small hexahedral portions having naturally cleaved planes. The smoky MgO, on the other hand, may include a plurality of cavities filled with $H_2$ gas. Accordingly, the crystal lattice structure of the smoky MgO may be distorted, i.e., may not be a substantially uniform hexahedral. Thus, a smoky MgO having a predetermined size may not be cleaved into small hexahedral portions. The lattice distortion may be formed due to strain formed by cubo-octahedral microstructures between lattices. The structural deformation in the smoky MgO may form an acceptor level in a band gap. The acceptor level may prevent or substantially minimize loss of wall charges after a discharge.

In addition, the smoky MgO may have a higher concentration of oxygen voids $V_O$ than the conventional single crystal MgO. Thus, the oxygen voids $V_O$ in the smoky MgO may form a donor level, thereby accelerating electron emission during a discharge. Further, when the smoky MgO is deposited using conventional vacuum evaporation, the $H_2$ gas in the cavities thereof may cause a reduction action. The $H_2$ gas may penetrate the MgO film, and may form an additional donor level immediately below a conduction level. Thus, emission of electrons may be further increased.

Accordingly, the smoky MgO may include improved acceptor and donor levels as compared to the conventional single crystal MgO. In particular, since the protective layer 116 according to embodiments of the present invention may include a large number of cavities in the single crystal MgO, i.e., smoky MgO, a high acceptor level, i.e., due to lattice distortion, may improve retention characteristics of wall charges. Also, the protective layer 116 may include a large amount of $H_2$ gas in the cavities, so donor level may be increased and no additional supply of $H_2$ gas to a deposition chamber during vacuum evaporation may be required. Further, the protective layer 116 may include a large amount of oxygen voids $V_O$ in the MgO lattice, thereby increasing the donor level further. Thus, in the smoky MgO, the acceptor level due to lattice distortion and the donor level due to hydrogen doping and oxygen voids $V_O$ may be well formed. Therefore, the smoky MgO may be more favorable for a high Xe gas discharge than a conventional single crystal MgO. Accordingly, the protective layer 116 having the smoky MgO may be suitable for realizing a full high definition single scan, low voltage discharge, and low power consumption PDP.

The protective layer 116 may further include a dopant. For example, the smoky MgO may be doped with one or more of aluminum (Al), calcium (Ca), iron (Fe), silicon (Si), potassium (K), sodium (Na), zirconium (Zr), manganese (Mn), chromium (Cr), zinc (Zn), boron (B), and/or nickel (N). A total amount of the dopant in the single crystal MgO of the smoky MgO may be about 50 ppm to about 250 ppm, e.g., about 100 ppm. For example, the protective layer 116 may include MgO containing a plurality of dopants. Table 1 below summarizes amounts of dopants in the protective layer 116 as determined by an inductively coupled plasma (ICP) analysis. A total dopant content may be adjusted by controlling amounts of major dopants in the single crystal MgO, e.g., Al, Ca, and Si.

TABLE 1

| | Dopant | | | | | | | | | | | |
|---|---|---|---|---|---|---|---|---|---|---|---|---|
| | Al | Ca | Fe | Si | K | Na | Zr | Mn | Cr | Zn | B | Ni |
| Content (ppm) | 30 | 7 | 14 | 30 | 2 | 2 | 2 | 4 | 1 | 1 | 2 | 2 |

Figure 3:
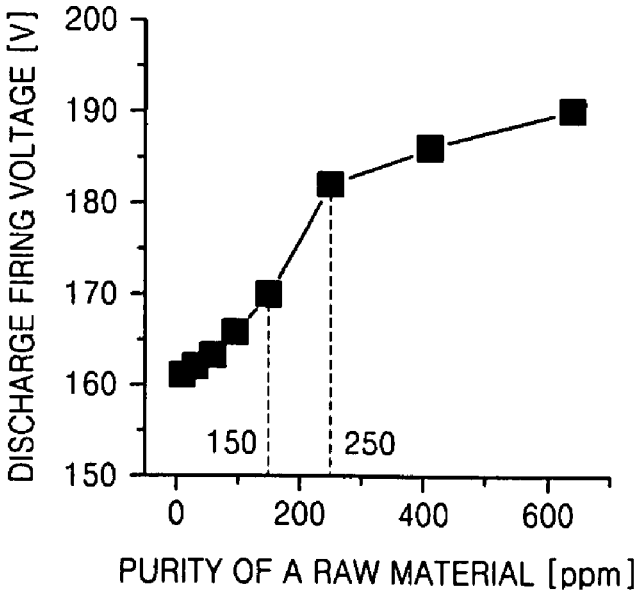
FIG. 3 illustrates a graph of a discharge firing voltage as a function of an amount of dopants in a protective layer according to an embodiment of the present invention.

FIG. 3 illustrates a graph of a relationship between the purity of the single crystal MgO, i.e., amount of dopants therein, and a discharge firing voltage when the protective layer 116 according to embodiments of the present invention is used in the PDP 100. As illustrated in FIG. 3, the discharge firing voltage varies with respect to a total amount of dopants in the MgO. In particular, as illustrated in FIG. 3, a large discharge firing voltage drop was observed when a total amount of dopants was between about 150 ppm and about 250 ppm. Thus, a reducing effect on the discharge firing voltage due to the smoky MgO in the protective layer 116 may be great when a total amount of dopants in the smoky MgO is below about 250 ppm, e.g., below 150 ppm. For convenience of manufacturing processes, the protective layer 116 may include dopants in an amount of about 50 ppm or above. Thus, the dopant content in the in the protective layer 116 may be about 50 ppm to about 250 ppm with respect to the MgO.

Figure 4:
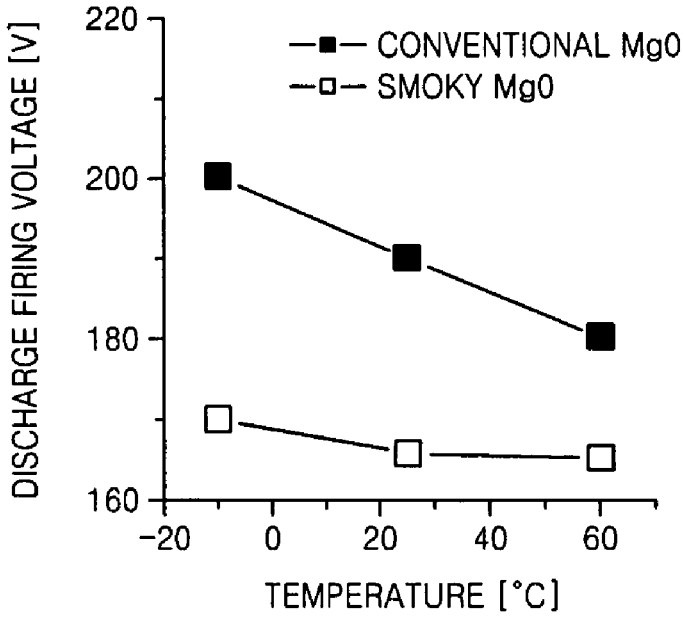
FIG. 4 illustrates a graph of a discharge firing voltage as a function of temperature when a protective layer according to an embodiment of the present invention is used.

FIG. 4 illustrates a graph of a relationship between temperature of MgO and a discharge firing voltage of a PDP. In particular, a conventional single crystal MgO and a smoky MgO were compared. Results illustrated in FIG. 4 were obtained by using a discharge gas including 15% by volume of Xe gas, 35% by volume of He gas, and Ne gas at a pressure of 350 Torr. As illustrated in FIG. 4, the smoky MgO exhibited lower discharge firing voltage than the conventional single crystal MgO. Further, the smoky MgO exhibited a very low temperature dependency.

A physical quantity directly related to the discharge firing voltage is a secondary electron emission coefficient of a material with respect to plasma ions. Since a secondary electron emission coefficient of a dielectric material may be relatively low, the secondary electron emission coefficient of the protective layer 116 may be increased.

Figure 5:
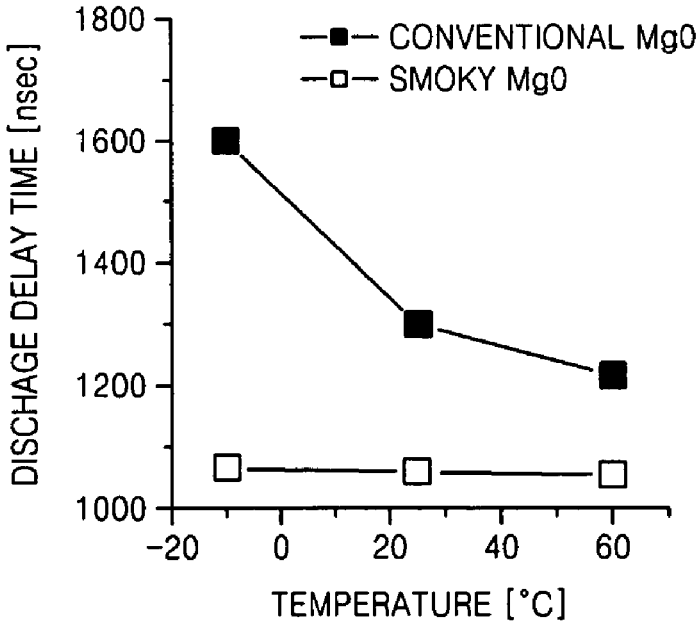
FIG. 5 illustrates a graph of a discharge delay time as a function of temperature when a protective layer according to an embodiment of the present invention is used.

FIG. 5 illustrates a graph of the relationship between temperature and a discharge delay time when the protective layer 116 according to embodiments of the present invention is used in the PDP 100. In particular, a conventional single crystal MgO and a smoky MgO were compared. Results illustrated in FIG. 5 were obtained by using a discharge gas including 15% by volume of Xe gas, 35% by volume of He gas, and Ne gas at a pressure of 350 Torr. As illustrated in FIG. 5, the smoky MgO exhibited a smaller discharge delay time than the conventional single crystal MgO. Further, the smoky MgO exhibited a very low temperature dependency. A shorter discharge delay time may increase a speed of addressing, so it may be possible to apply a single scan. Accordingly, the costs for manufacturing a scan drive can be reduced, and also, brightness and image quality of the PDP 100 may be improved by increasing a number of subfields.

The discharge delay time and the discharge firing voltage may be important discharge properties to consider when evaluating the protective layer 116. In FIGS. 4-5, it can be seen that the smoky MgO exhibited improved discharge delay time and discharge firing voltage, as compared to those of the conventional single crystal MgO. In other words, the protective layer 116 according to embodiments of the present invention may realize a low voltage discharge and high speed discharge while maintaining high Xe partial pressure. Thus, brightness of the PDP 100 may be increased by increasing a number of sustain pulses, and a false contour may be reduced by increasing the number of sub-fields per frame constituting a TV-field. Also, a scan circuit margin may be increased by minimizing the temperature dependency of the discharge delay time, and the discharge voltage increase may be prevented even at a high Xe content for high brightness by further reducing the discharge firing voltage. Accordingly, a full high definition single scan, low voltage discharge, and low power consumption PDP may be realized while exhibiting high brightness.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A protective layer of a plasma display panel (PDP), the protective layer comprising:

a magnesium oxide layer that combines magnesium oxide and magnesium hydroxide, the magnesium oxide layer having a single crystal magnesium oxide structure including a plurality of cavities to constitute a smoky magnesium oxide layer, the plurality of cavities being filled with hydrogen gas.

2. The protective layer as claimed in claim 1, wherein the hydrogen gas in the cavities is at a partial pressure of about 20 atm to about 200 atm.

3. The protective layer as claimed in claim 1, wherein the plurality of cavities have at least one of a hexahedral shape and an octahedral shape.

4. The protective layer as claimed in claim 1, wherein the protective layer has a distorted lattice structure based on the smoky magnesium oxide layer.

5. The protective layer as claimed in claim 1, wherein the plurality of cavities have a diameter of about 0.05 μm to about 10 μm.

6. The protective layer as claimed in claim 1, further comprising a dopant in the smoky magnesium oxide layer, the dopant including one or more of Al, Ca, Fe, Si, K, Na, Zr, Mn, Cr, Zn, B, and Ni.

7. The protective layer as claimed in claim 6, wherein an amount of the dopant in the smoky magnesium oxide layer is about 50 ppm to about 250 ppm.

8. The protective layer as claimed in claim 1, wherein the smoky magnesium oxide layer includes oxygen voids combined with magnesium oxide voids.

9. The protective layer as claimed in claim 1, wherein the the magnesium oxide is a compressed magnesium oxide powder, and the magnesium hydroxide is mixed with the compressed magnesium oxide powder.

10. The plasma display panel as claimed in claim 9, wherein the discharge gas includes a mixture of xenon gas and helium gas or a mixture of xenon gas, helium gas, and neon gas.

11. The plasma display panel as claimed in claim 10, wherein the discharge gas includes xenon gas in an amount of about 10% to about 30% by volume of a total discharge gas.

12. The protective layer as claimed in claim 1, wherein the protective layer is adapted to have a charge acceptor level based on a lattice distortion of the smoky magnesium oxide layer, and the protective layer is adapted to have a charge donor level based on at least the plurality of cavities filled with hydrogen gas in the smoky magnesium oxide layer.

13. A plasma display panel, comprising:

a first substrate facing a second substrate;

a plurality of barrier ribs between the first and second substrates, the barrier ribs defining a plurality of discharge cells;

a plurality of electrodes between the first and second substrates;

a protective layer between the first and second substrates, the protective layer including a magnesium oxide layer that combines magnesium oxide and magnesium hydroxide, the magnesium oxide layer having a single crystal magnesium oxide structure including a plurality of cavities to constitute a smoky magnesium oxide layer, the plurality of cavities being filled with hydrogen gas; and a discharge gas in the discharge cells.

14. The plasma display panel as claimed in claim 13, wherein the hydrogen gas in the cavities of the protective layer is at a partial pressure of about 20 atm to about 200 atm.

15. The plasma display panel as claimed in claim 13, wherein the plurality of cavities have at least one of a hexahedral shape and an octahedral shape.

16. The plasma display panel as claimed in claim 13, wherein the protective layer has a distorted lattice structure based on the smoky magnesium oxide layer.

17. The plasma display panel as claimed in claim 13, wherein the plurality of cavities in the protective layer have a diameter of about 0.05 μm to about 10 μm.

18. The plasma display panel as claimed in claim 13, wherein the protective layer includes a dopant in the smoky magnesium oxide layer, the dopant including one or more of Al, Ca, Fe, Si, K, Na, Zr, Mn, Cr, Zn, B, and Ni.

19. The plasma display panel as claimed in claim 18, wherein an amount of the dopant in the smoky magnesium oxide layer is about 50 ppm to about 250 ppm.

20. The plasma display panel as claimed in claim 13, wherein the protective layer is adapted to have a charge acceptor level based on a lattice distortion of the smoky magnesium oxide layer, and the protective layer is adapted to have a charge donor level based on at least the plurality of cavities filled with hydrogen gas in the smoky magnesium oxide layer.

* * * * *